US011926449B2

(12) United States Patent
Suvarna

(10) Patent No.: US 11,926,449 B2
(45) Date of Patent: Mar. 12, 2024

(54) CONTAINER CAPABLE OF STANDING ON ITS BOTTOM

(71) Applicant: Albea Services, Gennevilliers (FR)

(72) Inventor: Sudheer Suvarna, Gennevilliers (FR)

(73) Assignee: Albea Services, Gennevilliers (FR)

( * ) Notice: Subject to any disclaimer, the term of this patent is extended or adjusted under 35 U.S.C. 154(b) by 0 days.

(21) Appl. No.: 17/587,191

(22) Filed: Jan. 28, 2022

(65) Prior Publication Data

US 2022/0234781 A1 Jul. 28, 2022

(51) Int. Cl.
*B65D 3/12* (2006.01)
*B65D 3/04* (2006.01)

(52) U.S. Cl.
CPC ..... *B65D 3/12* (2013.01); *B65D 3/04* (2013.01)

(58) Field of Classification Search
CPC . B65D 3/04; B65D 15/04; B65D 3/12; B65D 15/08
See application file for complete search history.

(56) References Cited

U.S. PATENT DOCUMENTS 2,101,809 A 10/1935 Dreux
2013/0092697 A1* 4/2013 Guzzi ..... B31B 50/592 220/626
2014/0339230 A1* 11/2014 Keienburg ..... B65D 3/04 220/62.12
2014/0353202 A1* 12/2014 Park ..... B65D 15/08 206/524.6
2015/0136780 A1* 5/2015 Tamaro ..... B65D 17/502 220/640
2017/0355487 A1* 12/2017 Guertin ..... B65D 23/00
2020/0407100 A1* 12/2020 Hsu ..... B65D 3/22

FOREIGN PATENT DOCUMENTS

DE 215245 10/1909
WO WO 2013/167958 A1 11/2013

OTHER PUBLICATIONS

Written Opinion—INPI-FR, dated Oct. 27, 2021, 7-8.

* cited by examiner

*Primary Examiner* — Shawn M Braden
(74) *Attorney, Agent, or Firm* — Kilpatrick Townsend & Stockton LLP

(57) ABSTRACT

A container (1) extending along a longitudinal axis (X) and including a tubular body (10) having a longitudinal weld (11) substantially parallel to the axis (X), a bottom (20) and a head (30), the tubular body (10) including at least 50% by weight of paper, the bottom (20) including an annular distal end (21) and an oblique portion (22), the oblique portion (22) extending along an axis (Y) forming an angle α with the longitudinal axis (X), the tubular body (10) being attached to the bottom (20) at the level of the oblique portion (22).

18 Claims, 7 Drawing Sheets

[Fig. 1]
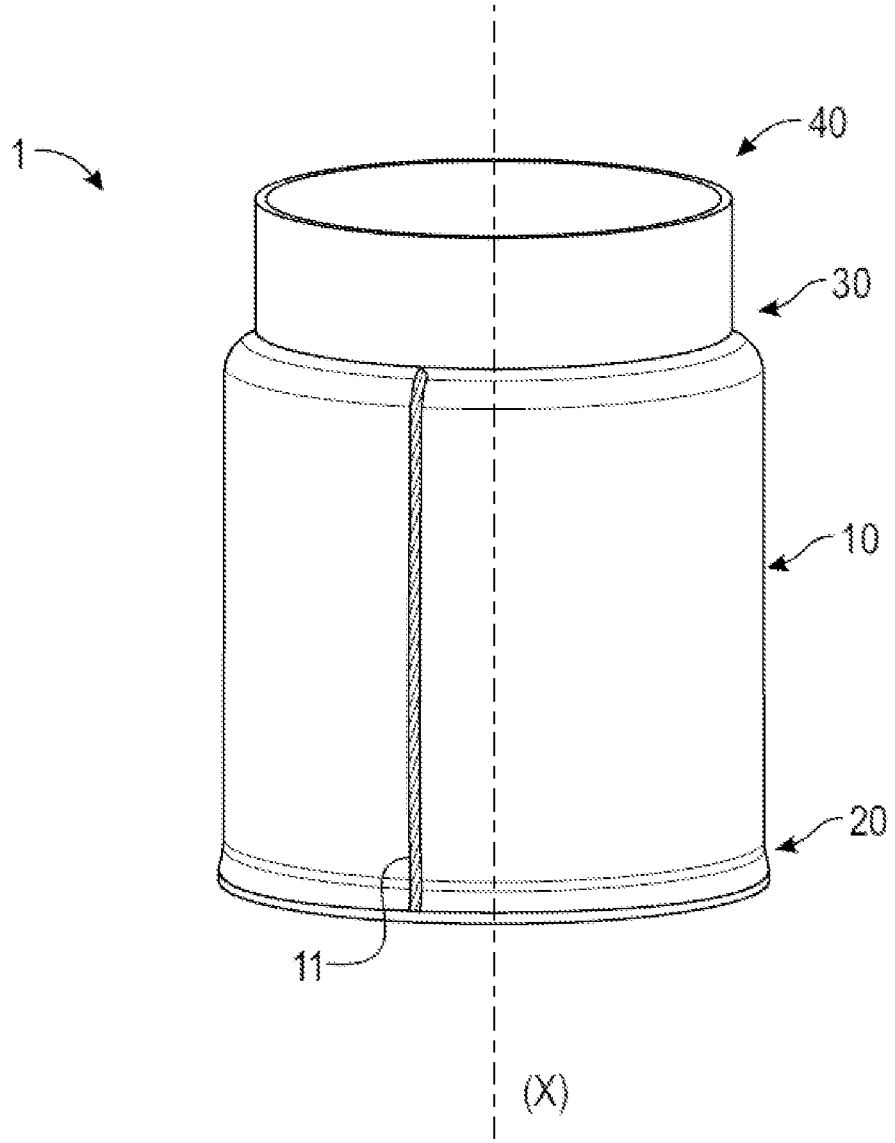

[Fig. 2]
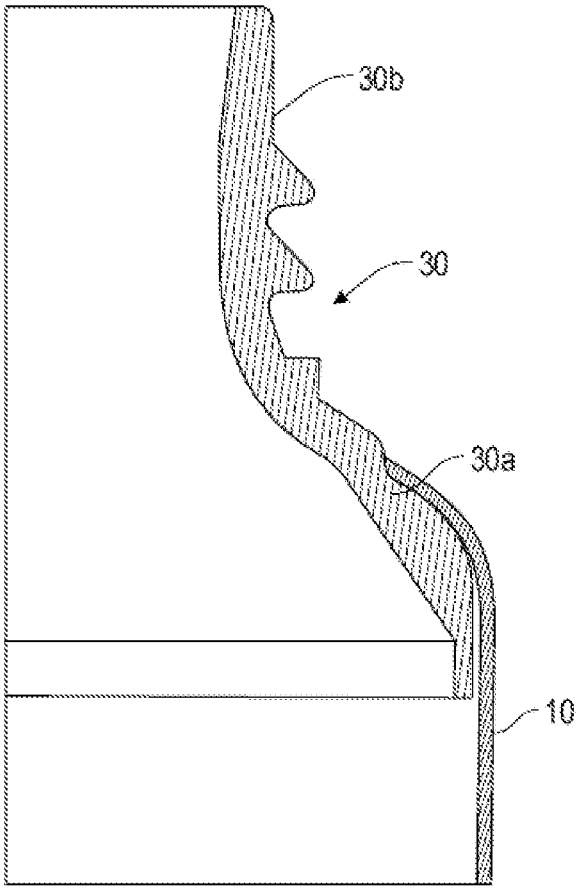

[Fig. 3]
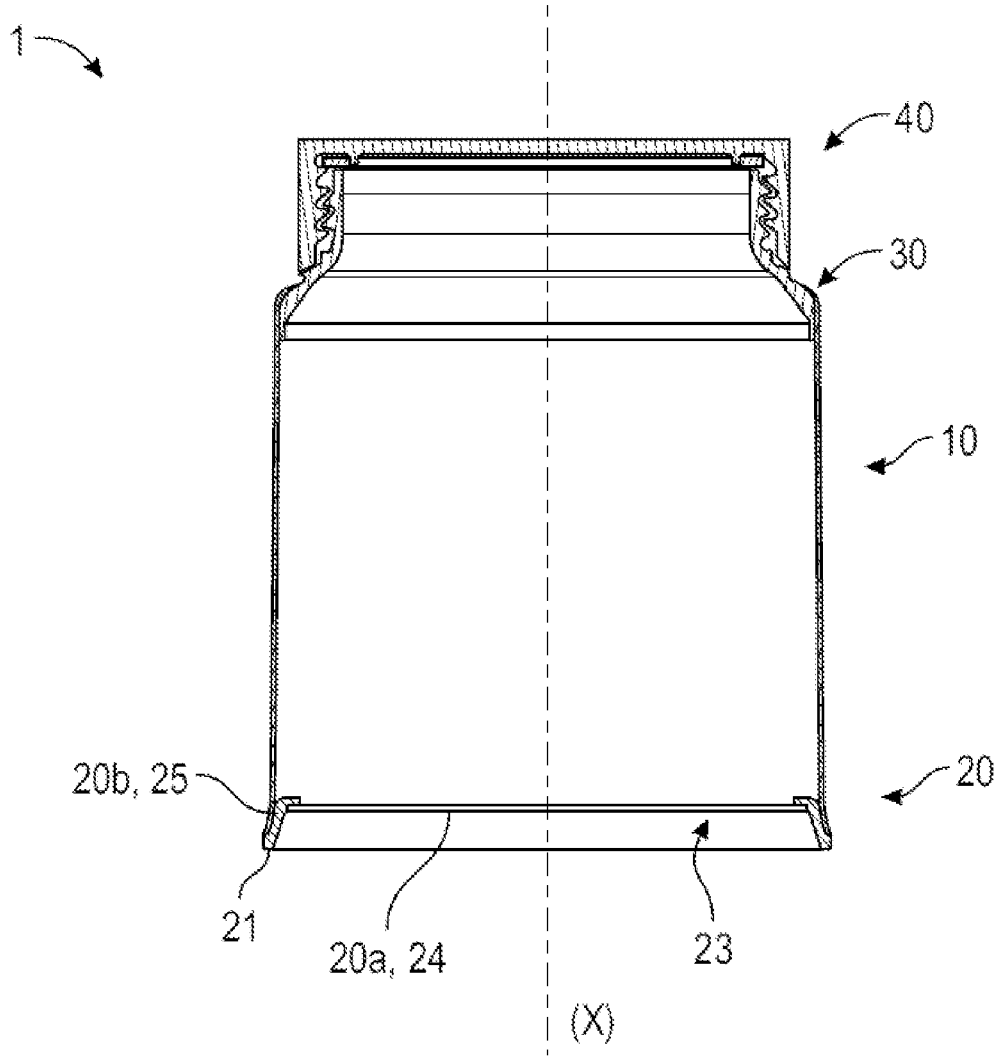

[Fig. 4]
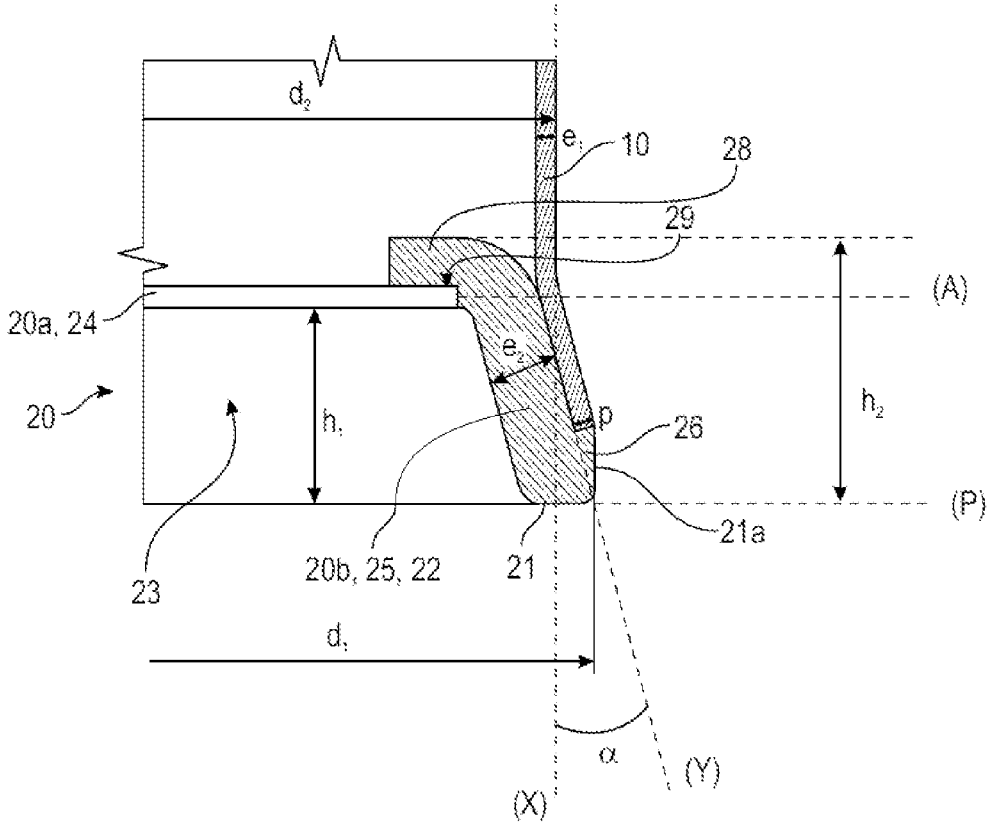

[Fig. 5]
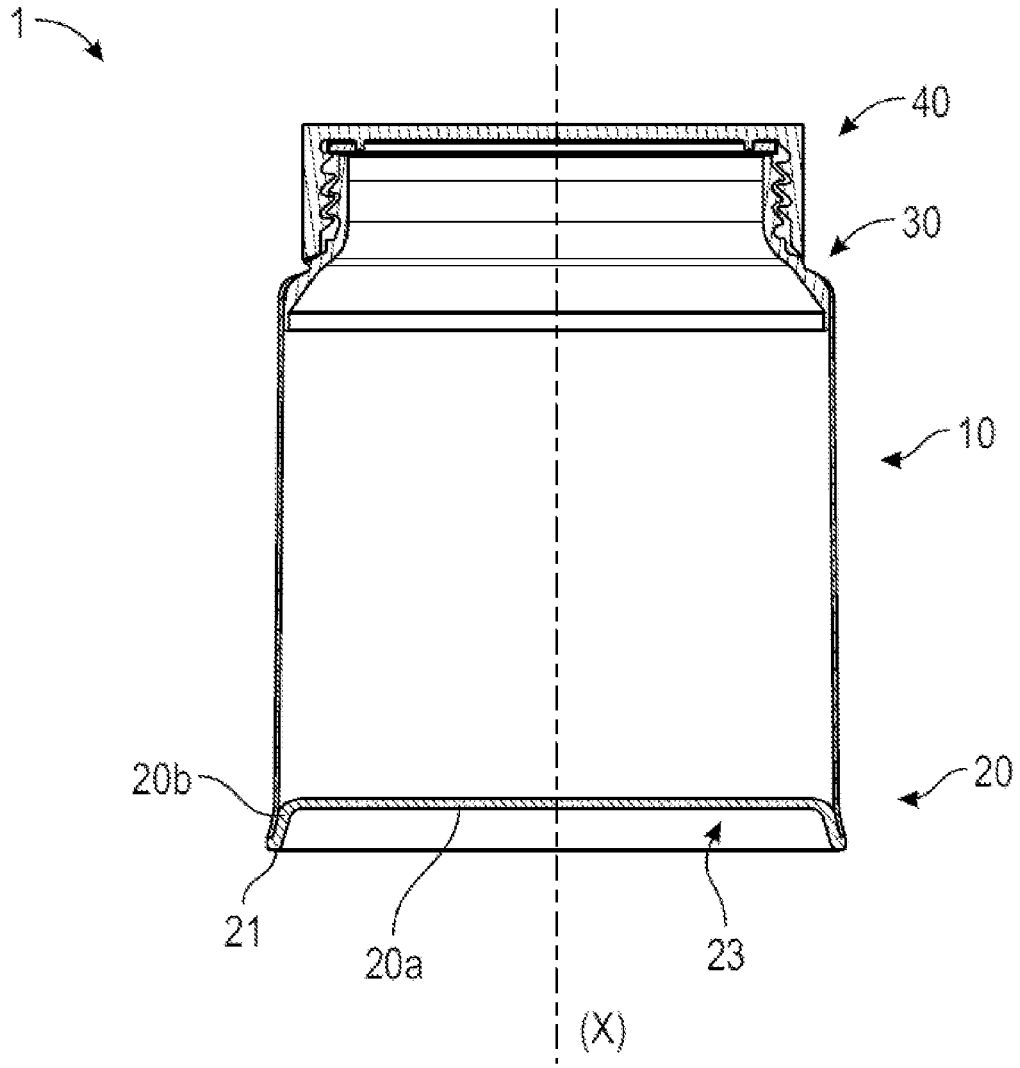

[Fig. 6]
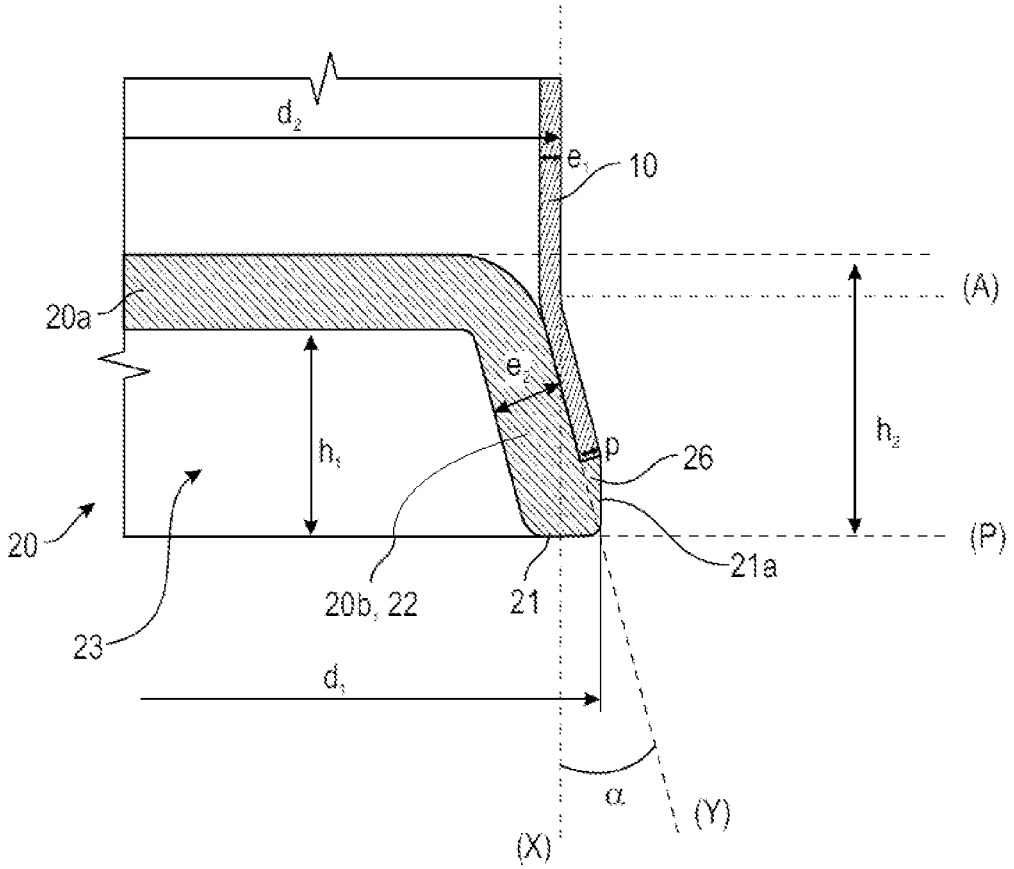

[Fig. 7]
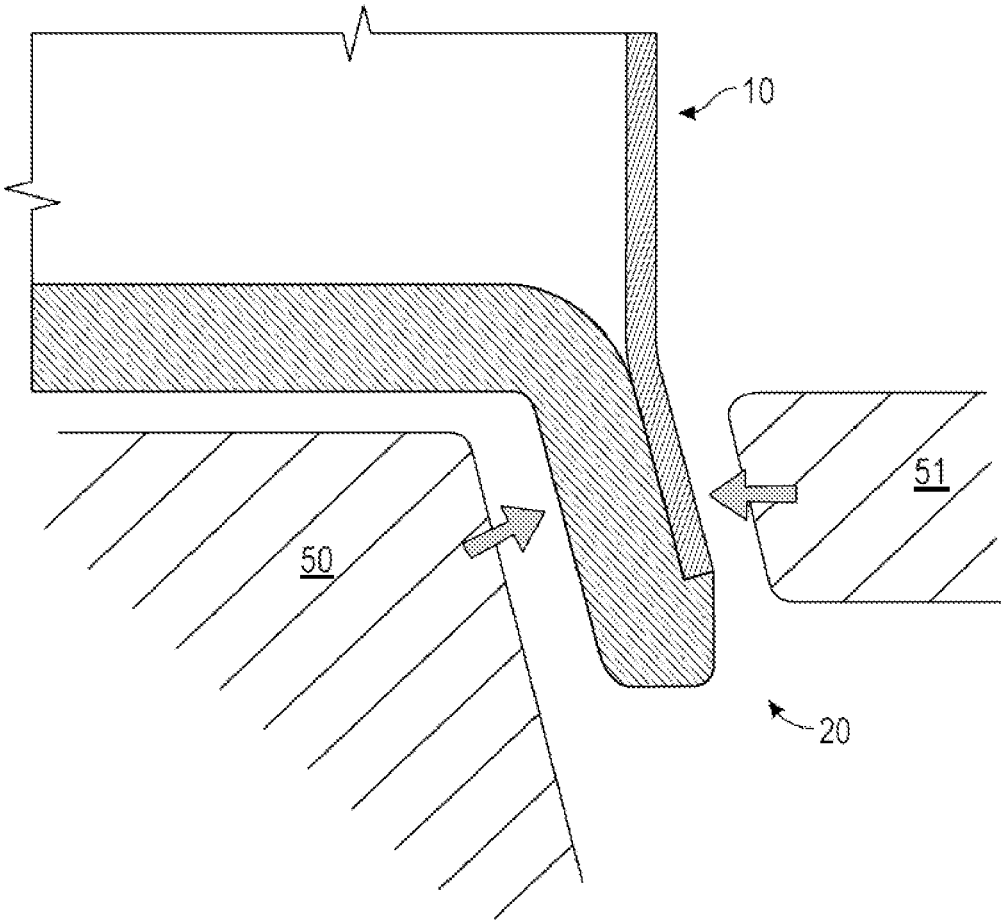

CONTAINER CAPABLE OF STANDING ON ITS BOTTOM

CROSS REFERENCE TO RELATED APPLICATIONS

This application claims priority under 35 U.S.C. § 119(a) to French patent application 2100834 filed on Jan. 28, 2021, the entire teachings of which are incorporated herein by reference.

BACKGROUND OF THE INVENTION

Field of the Invention

The present invention relates to a container capable of standing on its bottom and the recycling thereof.

Description of the Related Art

It is known that flexible tube-type containers include a tube head and a flexible skirt attached to the tube head. In particular, the tube is closed at its end opposite the head by welding the edge of the skirt to itself, thus creating a ridge-shaped bottom. In such a configuration, the container must be placed on its head so as to stand upright. It is an object of the present invention to modify such a container so that it can stand upright when placed on its bottom so that its head is oriented upwards. Furthermore, such a container should advantageously be compatible with existing bottle production lines. The bottle filling lines, unlike tube filling lines, require the bottle to be filled from above, i.e. through the neck. Once the filling is finished, you just have to screw or clip the cap on the bottle. In a tube filling line, the filling is done from the bottom, i.e. at the end opposite the neck/cap. After this filling, it is necessary to close the tube by an operation of welding the skirt to itself. Such a welding operation in the vicinity of the cosmetic formula contained in the tube is complex because it must not damage the cosmetic formula, for example by heat.

As to the recyclability of containers, nowadays, the global production of plastic is one of the largest sources of waste. The consumption and the recycling of these plastic products is a major concern of the national and regional organizations. The non-recycled plastic material are currently disposed of through a variety of methods ranging from landfill to energy recovery to thermal and chemical treatments. Some alternatives to plastics are being studied in many technical fields. In the field of the cosmetic packaging, it has already been envisaged to replace a certain proportion of plastics by paper. The use of paper/cardboard allows to reduce the environmental impact, measured in particular by a life cycle analysis, and decouples the packaging from materials of fossil origin and therefore not renewable. The paper/cardboard, in addition to being of renewable origin, is a material that can be recycled today and tomorrow.

BRIEF SUMMARY OF THE INVENTION

The objective of the present invention is to provide a container capable of standing upright, head towards the top, while advantageously limiting the amount of plastic in order to promote the recyclability of the container. To this end, the present invention relates to a container extending along a longitudinal axis (X) and including a tubular body having a longitudinal weld substantially parallel to the axis (X), a bottom and a head, the tubular body including at least 50% by weight of paper, the bottom including an annular distal end and an oblique portion, the oblique portion extending along an axis (Y) forming an angle α with the longitudinal axis (X), the tubular body being attached to the bottom at the level of the oblique portion.

The annular distal end of the bottom allows the container to stand upright head up. In addition, the oblique portion at the level of which the tubular body is attached allows for easy placement and attachment of the tubular body to the bottom and also allows for a compatibility with existing bottle production lines. Finally, the proportion of paper in the tubular body allows the container to be recycled.

The invention may also includes any of the following characteristics, taken individually or in any technically feasible combination:

- the bottom includes an undercut,
- the undercut has a height h1 of between 1 and 6 mm, in particular between 2.5 and 4 mm,
- the oblique portion is flared downwards,
- at least one part of the oblique portion has a diameter smaller than the internal diameter of the tubular body,
- the diameter of the upper part of the oblique portion is smaller than the internal diameter of the tubular body,
- the bottom includes a central disc and an annulus including the oblique portion,
- the disc is a laminate,
- the laminated disc includes at least one paper layer,
- the laminated disc includes at least one plastic layer,
- the laminated disc includes at least one EVOH barrier layer,
- the disc is essentially flat,
- the annulus includes a plastic material,
- the annulus includes PE,
- the annulus is made of plastic material,
- the annulus is made of PE,
- the tubular body is a laminate,
- the tubular body has a thickness e1 of between 200 and 600 μm,
- the tubular body includes PE,
- the tubular body includes a barrier layer of EVOH,
- the annulus includes an annular rim defining a support and/or a stop for the tubular body,
- the annular rim has a depth p greater than or equal to the thickness e1 of the tubular body,
- the tubular body is flush with the annular rim,
- the annulus has a height h of between 2 and 7 mm,
- the annulus has a height h of between 3.5 and 5.5 mm,
- the annulus includes an angled portion defining a housing for the disc,
- α is between 5 and 45°,
- the angle α is between 8 and 30°,
- the angle α is between 10 and 20°,
- the oblique portion has a thickness e2 between 0.1 and 2.5 mm,
- the annular rim has a depth p of between 0.1 and 0.7 mm,
- the bottom has a maximum external diameter d1,
- d1 is between 30 and 70 mm, in particular between 40 and 60 mm,
- the tubular body has an external diameter d2 upstream of the bottom,
- d2 is between 30 and 70 mm, in particular between 40 and 60 mm,
- the ratio d1/d2 is between 1.01 and 1.1,
- the ratio d1/d2 is between 1.01 and 1.05,
- the annulus has a minimum internal diameter of between 35 and 55 mm, the annulus has a minimum external diameter at the level of the oblique portion which is smaller than the internal diameter of the tubular body, the container includes at least 50% by weight of bio-sourced material, the container includes at least 50% by weight of paper, the container includes at least 60% by weight of paper, the container includes at least 70% by weight of paper.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIG. 1 is a perspective view of a container according to the invention,

FIG. 2 is a cross-sectional profile view of a head of a container according to the invention, FIG. 3 is a cross-sectional profile view of a container according to the invention, FIG. 4 is a zoom of FIG. 3, FIG. 5 is a cross-sectional profile view of another container according to the invention, FIG. 6 is a zoom of FIG. 5, FIG. 7 illustrates schematically the formation of a weld between the tubular body and the bottom of a container according to the invention

DETAILED DESCRIPTION OF THE INVENTION

As illustrated in FIGS. 1 to 6, the present invention relates to a container 1 extending along a longitudinal axis (X). The container includes a tubular body 10 having a longitudinal weld 11 substantially parallel to the axis (X), a bottom 20 and a head 30. Finally, the container is closed by a cap 40. The tubular body 10 may in particular be of the flexible skirt type. Advantageously, the tubular body 10 has the shape of a straight cylinder. The tubular body 10 includes at least 50% by weight of paper. As mentioned above, the paper is an easily recyclable material. This proportion of paper in the tubular body 10 thus allows to promote the recyclability of the container 1 according to the invention, in particular in the existing recycling stream of the food bricks or paper/plastic complexes.

As illustrated in particular in FIG. 2, the head 30 includes a shoulder 30*a* and a neck 30*b*. The shoulder 30*a* is the part of the head connected to the tubular body 10. The connection between the tubular body 10 and the shoulder 30*a* may be carried out in particular by welding or by over-molding. The neck 30*b* may include a thread allowing the screwing and the unscrewing of the cap 40. Alternatively, not shown, the cap 40 can be clipped onto the head 30. The head 30 is made of plastic material, for example polyethylene. The bottom 20 of the container 1 includes a wall 20*a* and a ring 20*b*. The wall 20*a* extends substantially in a plane A perpendicular to the longitudinal axis X. The ring 20*b* surrounds the wall 20*a* at the level of its periphery and includes an annular distal end 21 allowing the container 1 to stand upright head up. Indeed, this annular distal end 21 is contained in a plane P perpendicular to the longitudinal axis (X). The ring 20*b* also includes an oblique portion 22 extending along an axis (Y) forming an angle $\alpha \pm$ with the longitudinal axis (X). In particular, an oblique portion is defined as a portion including a vertical component and a radial component, so that the bottom 20 has a substantially frustoconical shape. It is at the level of this oblique portion 22 that the tubular body 10 is attached to the bottom 20. The oblique portion 22 allows to facilitate the placement and the attachment of the tubular body 10 to the bottom 20 and also allows a compatibility with the existing tube production lines.

Advantageously, as shown in FIGS. 3 to 6, the bottom 20 includes an undercut 23. This undercut is bounded by the external surface of the wall 20*a* and the ring 20*b* and forms a recess. The external surface is the surface facing the outside of the container. The attachment of the tubular body 10 to the bottom 20 is in particular carried out by welding by heating and applying a pressure to the tubular body 10 in the direction of the center of the container 1. The presence of this undercut 23 allows the introduction of a tool under the bottom 20 of the container 1 so as to manage a counter-pressure during the formation of the weld between the tubular body 10 and the bottom 20. FIG. 7 schematically illustrates the interaction between the bottom 20 of a container 1 according to the invention and tools 50, 51 when forming the weld between the tubular body and the bottom. The application of a pressure by the tools 50, 51 against the tubular body 10 and the bottom 20 is here represented by greyed arrows. Advantageously, the undercut 23 has a height h1 of between 1 and 6 mm, in particular between 2.5 and 4 mm. The height h1 is understood to be the distance between the external surface of the wall 20*a* and the plane P along a line perpendicular to the plane P. This range of height h1 allows the introduction of several types of tools adapted to manage a counter-support while limiting the space that may be considered lost because it is not part of the internal volume of the container.

Advantageously, the oblique portion 22 flares towards the outside of the container. To this end, the bottom 20 includes an annular radial end 21*a* defining the maximum radial cluttering of the bottom 20. In other words, the annular radial end 21*a* defines a maximum diameter d1 of the bottom 20. This annular radial end 21*a* is contiguous with the annular distal end 21. Thus, the diameter d1 of the annular radial end 21*a* is greater than the diameter defined by the intersection of the plane A and the external surface of the ring 20B. This flared shape towards the outside of the container is particularly advantageous in that it further facilitates the positioning of the bottom 20 within the tubular body 10. Indeed, in such a configuration, the tubular body is easily positioned against the oblique portion 22 of the bottom 20, the oblique portion 22 then acting as a guiding means for the tubular body 10 in its sealing position against the bottom 20. Furthermore, such a configuration implies that the tubular body 10 is deformed radially outwardly of the container 1 at the level of the bottom 20. This allows the tubular body to be put under tension, which is particularly advantageous for attaching the tubular body 10 to the bottom 20. Advantageously, the oblique portion has a thickness e2 of between 0.1 and 2.5 mm.

According to a first embodiment, as shown in FIGS. 2 and 3, the wall 20*a* of the bottom is formed by a central disc 24 and the ring 20*b* is formed by an annulus 25. The subdivision of the bottom into two separate pieces assembled or attached to each other, i.e. an annulus 25 and a disc 24, allows for better control of the composition of the bottom 20. In such a configuration, the disc 24 may be, in particular, a laminate. Such a laminate advantageously includes at least one paper layer and one plastic layer. The introduction of recyclable material, in particular at least one paper layer, further allows to enhance the recyclability of the container 1 according to the invention. This increases the paper content of the container, as the paper is located both in the tubular body 10 and in the bottom 20. Advantageously still, the laminated disc 24 includes at least one barrier layer, in particular an EVOH layer. Preferably, the disc 24 is substantially flat. The annulus 25 preferably includes a plastic material, in particular polyethylene (PE). Preferably still, the annulus 25 is made of plastic material, in particular PE.

Advantageously, the annulus 25 includes the oblique portion 22 and an angled portion 28 defining a housing 29 for the disc. Such a housing 29 allows a good attachment of the disc 24 to the annulus 25. Preferably, the annulus 25 has a height h2 of between 2 and 7 mm. Even more preferably, the annulus 25 has a height h2 of between 3.5 and 5.5 mm.

According to a second embodiment shown in FIGS. 5 and 6, the bottom 20 is made in one piece. The bottom 20 may then be made of plastic material, in particular PE (polyethylene). In this mode, the wall 20*a* and the ring 20*b* form a monolithic piece.

According to the two embodiments, the tubular body 10 is a laminate. The tubular body 10 includes at least one paper layer such that the tubular body 10 includes at least 50% by weight of paper. Preferably, the tubular body 10 has a thickness e1 of between 200 and 600¬μm. Advantageously, the thickness e1 is between 200 and 400 ¬μm. Advantageously, the tubular body includes polyethylene (PE). Advantageously, the tubular body includes a barrier layer, in particular of EVOH. As an example, the tubular body is constituted according to these 2 following examples:

Example 1 (from the External Layer to the Internal Layer)

Polyethylene layer
EVOH barrier layer
Polyethylene layer
Paper layer
Polyethylene layer Example 2 (from the External Layer to the Internal Layer)

Polyethylene layer
Paper layer
Polyethylene layer
EVOH barrier layer
Polyethylene layer Advantageously, in the two embodiments, as shown in FIGS. 4 and 6, the ring 20*b* includes an annular rim 26. The annular rim 26 corresponds to an excess thickness of material at the level of the annular radial end 21*a*. The annular rim 26 defines a support and/or a stop for the tubular body 10. Thus, when the tubular body 10 is positioned against the oblique portion 22 of the bottom 20 and guided into its sealing position against the bottom 20, the tubular body 10 comes in abutment against the annular rim 26. Once the tubular body is attached to the bottom 20 and the container is in an upright position on the bottom, the annular rim 26 serves to support the distal end of the tubular body.

Furthermore, the annular rim 26 also serves as a stop when pressure is applied when attaching the tubular body 10 to the bottom 20. Indeed, as mentioned above, the attachment of the tubular body 10 to the bottom 20 is in particular carried out by welding by heating and applying a pressure to the tubular body 10 in the direction of the center of the container 1. The thickness e1 of the tubular body is then locally reduced by the application of pressure, this being due in particular to the paper content of the tubular body. The local reduction of the thickness e1 may also be due to the creep of plastic material at the level of the weld area. The presence of the annular rim 26 thus allows to limit an excessive crushing of the tubular body 10 which could damage its structure. In addition, the annular rim 26 serves to protect the slice of the tubular body 10. Indeed, the annular rim 26, by the heat of the welding method, will weld to the slice of the tubular body 10 and thus act as a moisture barrier to the paper layer included within the tubular body 10.

Preferably, the annular rim 26 has a depth p greater than or equal to the thickness e1 of the tubular body. Thus, the slice of the tubular body 10, constituting a sensitive area, is protected. The annular rim advantageously has a depth p of between 0.1 and 0.7 mm, in particular between 0.2 and 0.5 mm. Even more preferably, the tubular body 10 is flush with the annular rim 26. Thus, the boundary between the tubular body 10 and the bottom 20 will be only slightly visible, which is aesthetically particularly appreciable. Before the weld between the tubular body 10 and the bottom 20 is carried out, the thickness e1 of the tubular body 10 may be greater than the depth p, the annular rim 26 then acting as a stop and allowing to limit an excessive crushing of the tubular body 10.

The container 1 according to the invention has a particularly advantageous design and dimensions. As mentioned above, the oblique portion 22 extending along an axis (Y) forming an angle Œ ± with the longitudinal axis (X). This angle Œ ± thus defines the inclination of the oblique portion 22. An inclination that is too small, thus corresponding to an angle Œ ± tending towards 0, would not allow to achieve the desired effect of improving the positioning of the tubular body 10. An inclination that is too steep could also prevent the desired effect from being achieved and would not be aesthetically pleasing. Advantageously, the angle Œ ± is between 5 and 45¬∞. Advantageously still, the angle Œ ± is between 8 and 30¬∞. Advantageously still, the angle Œ ± is between 10 and 20¬∞.

As shown in FIGS. 4 and 6, the bottom 20 has a maximum external diameter d1. Advantageously, d1 is between 30 and 70 mm. Advantageously, d1 is between 40 and 60 mm.

The tubular body has an external diameter d2, upstream of the bottom 20. The diameter d2 is therefore the external diameter of the skirt. Advantageously, d2 is between 30 and 70 mm. Advantageously still, d2 is between 40 and 60 mm.

Once the diameters d1 and d2 have been defined, it is possible to determine a ratio d1/d2. Such a ratio is representative of the shape of the container at the level of its base. A ratio d1/d2 greater than 1 implies that the tubular body is deformed outwardly from the container at the level of the bottom 20. Such a deformation allows the tubular body to be put under tension, which is particularly advantageous for attaching the tubular body 10 to the bottom 20. However, if the ratio d1/d2 is too high, this can lead to excessive deformation of the tubular body and damage it. In addition, a container that is too flared outwards at the level of the base is not particularly aesthetically pleasing. A ratio d1/d2 equal to 1 means that, for a tubular body having the shape of a straight cylinder, the bottom 20 is straight and perfectly aligned with the tubular body 10. Such a configuration does not allow a tensioning as mentioned above. Advantageously, the ratio d1/d2 is between 1.01 and 1.1. Such a ratio allows to obtain the desired effect of tensioning and improving the positioning and the attachment of the tubular body 10 on the bottom 20 while maintaining a satisfactory design. Advantageously still, the ratio d1/d2 is between 1.01 and 1.05.

Preferably, the container 1 according to the invention includes at least 50% by weight of bio-sourced or recycled materials. The bio-sourced material can in particular be paper. As mentioned above, it is possible to increase the proportion of paper in the container not only by using paper in the tubular body, but also by forming a bottom 20 with a disc 24 also including paper. Advantageously, the container 1 according to the invention includes at least 60% by weight of paper. Advantageously still, the container 1 according to the invention includes at least 70% by weight of paper, in particular at least 70% by weight of paper Of note, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", and/or "including," when used in this specification, specify the presence of stated features, integers, steps, operations, elements, and/or components, but do not preclude the presence or addition of one or more other features, integers, steps, operations, elements, components, and/or groups thereof.

As well, the corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows.

The invention claimed is:

1. A container extending along a longitudinal axis and comprising a tubular body having a longitudinal weld substantially parallel to the axis, a bottom and a head, said tubular body comprising at least 50% by weight of paper, said bottom comprising an annular distal end and an oblique portion, said oblique portion extending along an axis forming an angle with the longitudinal axis, the tubular body being attached to said bottom at a level of said oblique portion, the head comprising a distribution orifice and an attachment surface for attaching the tubular body.

2. The container according to claim 1, wherein the bottom comprises an undercut.

3. The container according to claim 1, wherein the oblique portion flares out towards an outside of the container.

4. The container according to claim 1, wherein the bottom comprises an annular rim defining a stop for the tubular body.

5. The container according to claim 4, wherein the annular rim has a depth greater than or equal to a thickness of the tubular body.

6. The container according to claim 4, wherein the annular rim has a depth between 0.1 and 0.7 mm.

7. The container according to claim 1, wherein the angle is between 5 and 45°.

8. The container according to claim 1, wherein the oblique portion has a thickness e2 between 0.1 and 2.5 mm.

9. The container according to claim 1, wherein the bottom has a maximum external diameter and the tubular body has an external diameter upstream of the bottom, a ratio of the maximum external diameter of the bottom to the maximum external diameter of the tubular body being between 1.01 and 1.1.

10. The container according to claim 1, wherein at least one part of the oblique portion has a diameter smaller than an internal diameter of the tubular body.

11. The container according to claim 1, wherein the bottom comprises a central disc and an annulus comprising the oblique portion.

12. The container according to claim 11, wherein the disc is a laminate.

13. The container according to claim 12, wherein the disc comprises at least one paper layer and at least one plastic layer.

14. The container according to claim 11, wherein the annulus comprises plastic.

15. The container according to claim 1, wherein the container comprises at least 50% by weight of paper.

16. The container according to claim 1, wherein the angle is between 10 and 20°.

17. The container according to claim 1, wherein the bottom has a maximum external diameter and the tubular body has an external diameter upstream of the bottom, a ratio of the maximum external diameter of the bottom to the maximum external diameter of the tubular body is between 1.01 and 1.05.

18. The container according to claim 14, wherein the plastic comprises polyethylene (PE).

* * * * *